US006690252B2

(12) United States Patent
Scoltock Jr. et al.

(10) Patent No.: US 6,690,252 B2
(45) Date of Patent: Feb. 10, 2004

(54) RF CIRCUIT ASSEMBLY

(75) Inventors: Sutton Scoltock Jr., Aliso Viejo, CA (US); Yaozhong Liu, Torrance, CA (US); Paul Rosadiuk, Gardena, CA (US); Shih-Chang Wu, Ramcho Palos Verdes, CA (US); Herbert Suyematsu, Los Angeles, CA (US); Richard Fanucchi, Fountain Valley, CA (US)

(73) Assignee: The Boeing Company, Chicago, IL (US)

( * ) Notice: Subject to any disclaimer, the term of this patent is extended or adjusted under 35 U.S.C. 154(b) by 128 days.

(21) Appl. No.: 09/992,258

(22) Filed: Nov. 19, 2001

(65) Prior Publication Data

US 2003/0095020 A1 May 22, 2003

(51) Int. Cl.[7] ..... H01P 3/08
(52) U.S. Cl. ..... 333/246; 333/260; 333/26
(58) Field of Search ..... 333/260, 246, 333/247, 26, 99 R

(56) References Cited

U.S. PATENT DOCUMENTS

| | | | | | |
|---|---|---|---|---|---|
| 5,019,829 | A | * | 5/1991 | Heckman et al. | 343/700 MS |
| 5,363,075 | A | | 11/1994 | Fanucchi | |
| 5,450,046 | A | * | 9/1995 | Kosugi et al. | 333/246 |
| 5,886,671 | A | * | 3/1999 | Riemer et al. | 343/776 |
| 6,028,497 | A | * | 2/2000 | Allen et al. | 333/246 |
| 6,064,286 | A | * | 5/2000 | Ziegner et al. | 333/247 |
| 6,160,412 | A | * | 12/2000 | Martel et al. | 324/761 |

* cited by examiner

*Primary Examiner*—Robert Pascal
*Assistant Examiner*—Kimberly E Glenn
(74) *Attorney, Agent, or Firm*—Terje Gudmestad

(57) ABSTRACT

A circuit assembly suitable for RF signals has an integration plate and an RF distribution layer disposed adjacent to the integration plate. The RF distribution layer has an RF conductive layer between a first dielectric layer and a second dielectric layer. A DC distribution layer is disposed adjacent to the RF distribution layer. An RF input is coupled to the RF conductive layer. A module assembly includes an integrated circuit coupled to the RF conductive layer and the DC distribution layer. An RF output is coupled to the RF conductive layer.

27 Claims, 3 Drawing Sheets

RF CIRCUIT ASSEMBLY

FIELD OF THE INVENTION

The present invention pertains to the field of microwave communications and more particularly to a multiple layer assembly for connecting microwave integrated circuit modules.

BACKGROUND OF THE INVENTION

In many applications including communications satellites, Microwave Integrated Circuits (MIC's) and Monolithic Microwave Integrated Circuits (MMIC's) are typically packaged in custom-built module assemblies composed of microstrip substrates supported by machined Kovar and aluminum parts. These individual module assemblies are grouped together in a machined aluminum chassis to perform more complex functions. The machined aluminum chassis is a complex array of radio frequency circuit cavities, DC wiring channels and precision mounting bosses, typically custom designed for each application. The resulting assembly is complex, expensive, and capable of achieving only those functions which are designed into it.

One approach is shown, for example, in U.S. Pat. No. 5,363,075, to the assignee of this application. The '075 patent uses a header supporting a microwave integrated circuit. A domed cover is hermetically sealed to the header. Interconnection pins extend from the bottom of the header and are coupled to a connector assembly. The pins are used for coupling microwave and DC power to the microwave integrated circuit. The RF pins are fed through the assembly for interconnection. A RF ribbon couples the integrated circuit to an RF input. One drawback to such this design is that the labor associated with the assembly is high. This is due in part to the RF feedthrough and the order of operations used in the assembly. One of the most time intensive steps of the assembly process is the tuning of the RF ribbon. For proper operation, the ribbon must be tuned during assembly to obtain the maximum RF coupling. During the tuning process, the shape and length of the ribbon is modified. Also, a number of different tuning techniques may be used. Because of the extreme sensitivity, tuning must be done for each ribbon of the assembly. Numerous ribbons may be used in a satellite.

In communications satellites, there is an ever-increasing need to reduce the size and therefore the weight of the components contained therein. Also, there is a need to increase packaging and connector density, reduce assembly time and number of parts, and improve reliability. Known communication assemblies were relatively large devices and thus had significant weight. Prior art uses coaxial cables or connectors to interconnect slices or units taking up space and weight.

SUMMARY OF THE INVENTION

The present invention provides a repeatable, more precise and secure connector assembly, which also is tuneless therefore less labor intensive for interconnecting microwave integrated circuit modules and slices (trays).

In one aspect of the invention, a circuit assembly suitable for RF signals has an integration plate and an RF distribution layer disposed adjacent to the integration plate. The RF distribution layer has an RF conductive layer between a first dielectric layer and a second dielectric layer. A DC distribution layer is disposed adjacent to the RF distribution layer.

An RF input is coupled to the RF conductive layer. A module assembly includes an integrated circuit coupled to the RF conductive layer and the DC distribution layer. An RF output is coupled to the RF conductive layer.

In a further aspect of the invention, a method of assembling a circuit comprises the steps of:

mounting an integrated circuit to a header;

coupling a DC pin to the integrated circuit;

positioning an opening in the header sized to receive a contact to directly contact the integrated circuit; and affixing a cover to the integrated circuit, and thereby forming a circuit module.

One advantage of the invention is that reliability and yield of an assembly formed according to the present invention is increased; cost, cycle time are decreased due to the elimination of parts and processes in the assembly process.

Another advantage of the invention is that numerous high density RF interconnections can be made resulting in smaller modules and units. The interconnection method can be used between slices or units resulting in smaller units and subsystems.

Other objects and features of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
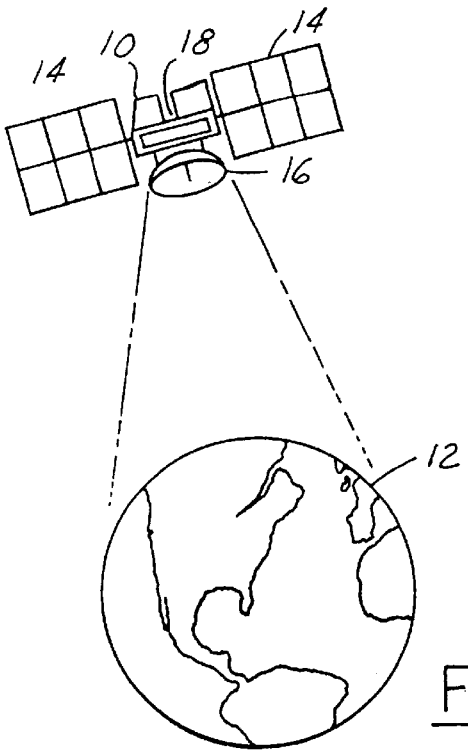
FIG. 1 is a perspective view of a satellite having a circuit assembly formed according to the present invention positioned above the earth.

In the following figures, the same reference numerals are used to identify identical components. Although the present invention is described with respect to a satellite, the present invention is also suitable for other radio frequency (RF) applications such as ground stations or land based communications. In the following description, RF is to include microwave signals.

Referring now to FIG. 1, a satellite 10 is positioned for communications with earth 12. Solar panels 14 provide electricity to operate satellite 10. Communications with earth 12 are performed through an antenna 16. Antenna 16 is shown to represent both the transmission and reception of communications signals. Satellite 10 may be part of a network (not shown) and has means to communicate with the other satellites in the network. Satellite 10 may be positioned in various earth orbits including low earth orbit, medium earth orbit, high earth orbit, or geostationary orbit. Satellite 10 may be used for point-to-point communication or for broadcast communications.

Satellite 10 has a circuit assembly 18 positioned therein. Circuit assembly 18 among its many potential uses may be used to process communication signals. Circuit assembly 18 is particularly suitable for use in communications having RF frequencies.

Figure 2:
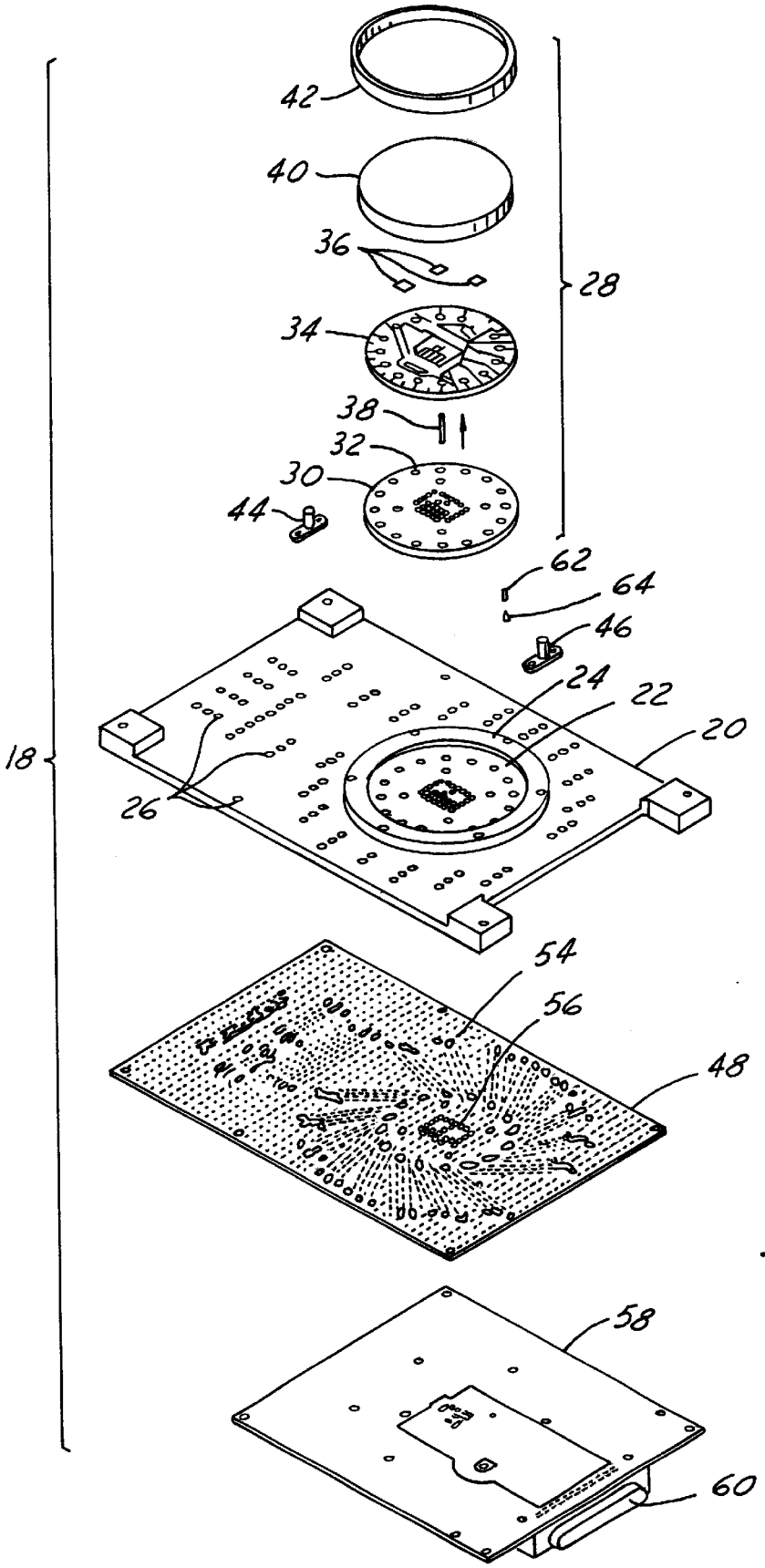
FIG. 2 is an exploded view of a portion of a circuit assembly according to the present invention.

Referring now to FIG. 2, an exploded view of a portion of circuit assembly 18 according to the present invention is illustrated. The portion of circuit assembly 18 is likely to be one of a plurality of circuit assemblies within a satellite. The circuit assembly portion may be referred to as a slice. The circuit assembly 18 has an integration plate 20 to which the remaining portions of circuit assembly 18 are connected. Integration plate 20 is a substantially flat aluminum plate having a module cavity 22 defined by a wall member 24 extending therefrom. In a satellite implementation, integration plate 20 may contain a plurality of module cavities. As illustrated, wall member 24 has a circular shape. However, wall member 24 may comprise a variety of other shapes, such as rectangular. Integration plate 20 has a plurality of holes 26 extending therethrough. Holes 26, as will be further described below, provide mounting locations and through holes for a circuit interconnector.

A module assembly 28 is sized to be received within module cavity 22. Module assembly 28 has a header 30 which is preferably constructed of Kovar, an iron nickel cobalt alloy, or a similar alloy or other similar material. Header 30 has through holes 32 that seat a pressure contact that are used for interconnecting the module assembly 28 through the integration plate 20 to RF distribution board 48.

Module assembly 28 has an integrated circuit 34. Integrated circuit 34 is affixed to header 30 during assembly. Therefore, integrated circuit 34 is preferably sized similarly to that of header 30.

Integrated circuit 34 may perform a variety of functions including the processing of RF and DC signals. Integrated circuit 34 has various electrical components 36 coupled thereto in a known manner. Although only three electrical components 34 are shown, the illustrated module is suitable to hold sixteen electrical components 34. Components 34 may include monolithic microwave integrated circuits (MMICS). The number of components varies with the application.

Integrated circuit 34 may be a single or multi-layer substrate. In the present example, twenty-three layers are used. Various materials including low temperature cofired ceramic (LTCC) or a polyimide may be used. The number of layers, the material used and the circuit interconnections through the layers are dependent upon the function of the module.

As those skilled in the art will recognize, mechanical means for aligning the substrate and header may be used. For example, a dowel pin or other mechanical key may be used.

DC pins 38 are coupled to integrated circuit 34. Although only one DC pin 38 is illustrated, a plurality of pins may be employed. DC pins 38 may carry command, control and power source signals to module assembly 28.

A cover 40 is used to enclose the module assembly 28. Cover 40 may also be formed of Kovar. As will be illustrated below, cover 40 may be welded or otherwise bonded, or held in place by spanner ring 42, to header 30. For various implementations, cover 40 may hermetically seal module assembly 28.

A spanner ring 42 is used to secure module assembly 28 to cavity floor 22 of integration plate 20 as will be best shown in FIG. 4 below. Spanner ring 42 provides force for RF ground between module and plate allowing dense grouping of RF ports resulting in smaller, lighter assembly. Prior art used multiple screws between parts and ports.

RF input 44 and an RF output 46 are known to those skilled in the art. As will be further described below, RF input 44 and RF output 46 have a pin that is coupled through integration plate 20. As shown, RF input 44 and RF output 46 are coaxial connectors. Although only one RF input 44 and one RF output 46 are illustrated, sufficient holes 26 are illustrated for eight inputs and eight outputs although any number is possible. RF input 44 and RF output 46 may be secured to integration plate 20 through the use of conventional fasteners such as screws.

A multilayer RF distribution board 48 is coupled adjacent to integration plate 20. Various reduced thickness cavity areas 54 and holes for DC feedthroughs 56 are provided throughout RF distribution board 48 for DC coupling of power and command signals to module 28 and for RF coupling to the layers within RF distribution board as further described below.

A DC distribution layer 58 is coupled adjacent to RF distribution plate 48. DC distribution layer 58 may have a connector 60 positioned thereon for receiving and transmitting DC (or AC) signals. Various electrical components (not shown) such as discrete components or chips may be mounted to the DC distribution layer 58. DC distribution layer 58 may comprise a plurality of layers including dielectric layers between any conductive layers. DC pins 38 extend from integrated circuit 34 through header 30, integration plate 20, and RF distribution board 48 to DC distribution layer 58, DC pins 38 may be coupled to header 30 in a variety of manners including soldered.

A pressure contact 62 surrounded by a dielectric spacer 64 may be used to couple integrated circuit 34 to RF distribution board 48. As is shown below, a number of pressure contacts may be employed. Dielectric spacer 64 prevents electrical contact with the various layers through which the pressure contacts extend. Dielectric spacer 64 helps create a coaxial structure with contact 62.

Figure 3:
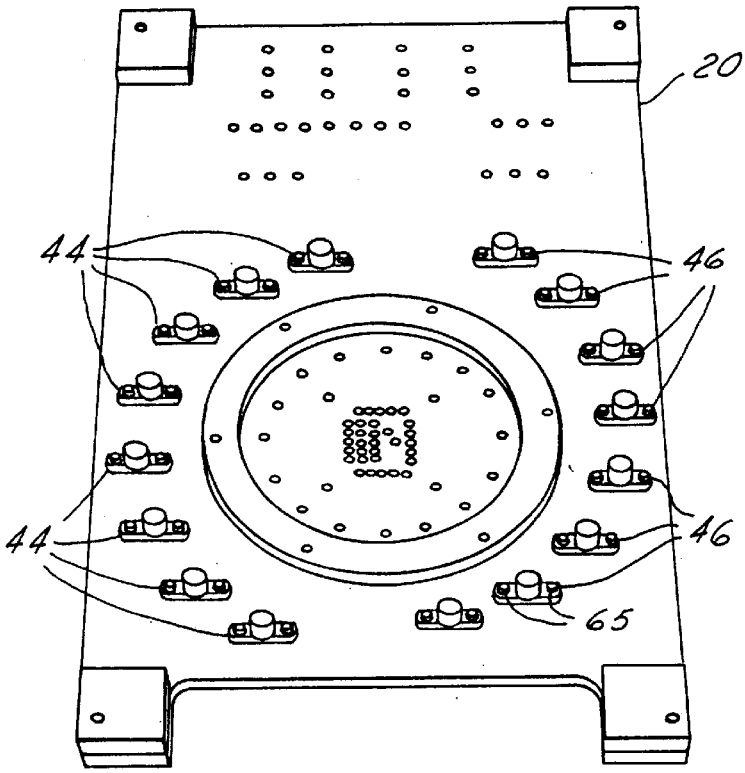
FIG. 3 is a perspective view of an integration plate utilized with the present invention.

Referring now to FIG. 3, integration plate 20 is shown having eight RF inputs 44 and eight RF outputs 46 mounted thereto with fasteners 65 securing the inputs 44 and outputs 46 thereto.

Figure 4:
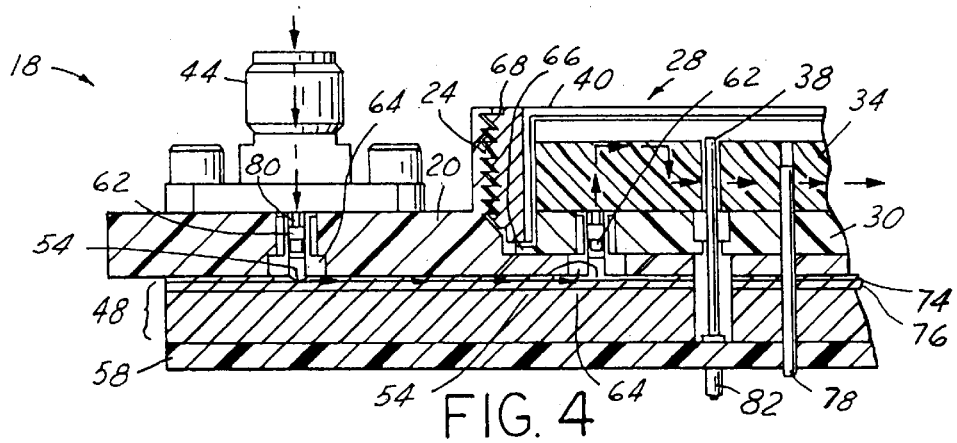
FIG. 4 is a cross-sectional view of a circuit assembly formed according to the present invention.

Referring now to FIG. 4, a partial cross-sectional view of circuit assembly 18 is illustrated. The assembly 18 shows a portion of module assembly 28 and an RF input 44. In this example, header 30 has a shoulder 66 that is used to couple cover 40 thereto. Spanner ring 42 has threads 68 that interconnect with threads 70 in wall member 24. Pressure from spanner ring 42 is exerted on shoulder 66. Thus, module 28 is secured within cavity 22 of integration plate 20 by movement of spanner ring 42.

RF distribution board 48 has a copper clad or conductive first dielectric layer 72 adjacent to integration plate 20, an RF conductive layer 74 adjacent to dielectric layer 72, and a copper clad second dielectric layer 76 positioned adjacent to RF conductive layer 74. Also not shown in FIG. 3 above is a dowel pin 78 used for locating the various layers during assembly.

In operation, RF signals enter RF input 44. RF input 44 has an input pin 80 thereunder. RF input pin 80 contacts pressure contact 62. RF contact 82 also is RF coupled to RF conductive layer 74 at a reduced thickness cavity area 54. RF signals travel through RF distribution board 48. RF distribution board 48 is a stripline circuit with microstrip at reduced cavity thickness areas. Another pressure contact 62 is located within module 28. Pressure contact 62 contacts RF conductive layer 74 at a reduced thickness area 54. RF signals are then coupled through pressure contact 62 to integrated circuit 34. RF signals while being processed travel through integrated circuit 34 and exit module 28 in a similar manner to the input.

DC signals are coupled from DC distribution layer 58 through DC socket 82. A feed through 38 couples socket 82 to integrated circuit 34. Because feed through 38 is used to couple DC signals, feed through 38 does not have to be tuned as if it were coupling an RF signal as in prior known circuits. A wirebond or variety of methods makes final connection between pin and circuit 34.

Figure 5:
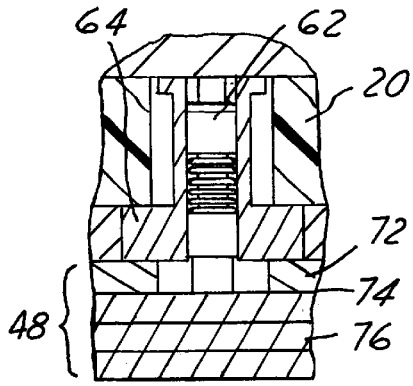
FIG. 5 is a cross-sectional view of an RF interconnection.

Referring now to FIG. 5, pressure contact 62 is shown in greater detail coupled through integration plate 20. As shown, dielectric spacer 64 separates pressure contact 62 from integration plate 20 and forms coaxial structure. Pressure contact 62 is RF coupled to RF conductive layer 74 where a portion of dielectric layer 72 has been removed to form reduced thickness cavity area 54. The small structure combined with spanner ring results in high density RF ports. Pressure contact 62 directly contacts pad on back side of integrated circuit 34 resulting in elimination of RF pin used in prior art that required tuning.

Figure 6:
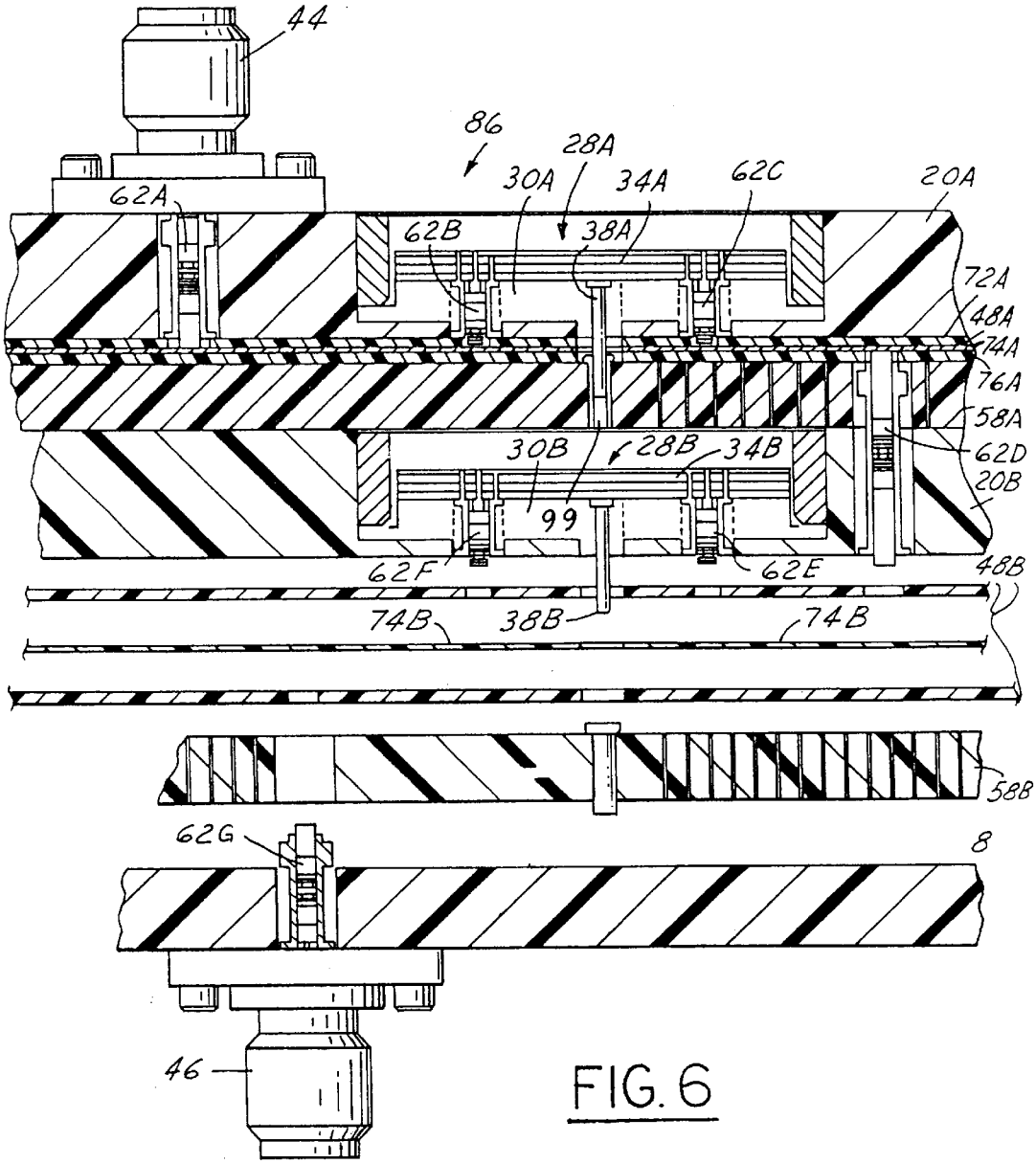
FIG. 6 is a cross-sectional partially exploded view of a multi-slice circuit assembly formed according to the present invention.

Referring now to FIG. 6, the present invention may be employed in a multiple slice circuit 86. Multiple slice circuit 86 rather than having a single module 28 as shown in FIG. 4, has a plurality of modules of which two modules 28A, 28B are shown. Various numbers of modules with various numbers of RF inputs and RF outputs may be employed. In the present partial view, one RF input 44 and one RF output 46 is illustrated.

Each module 28A, 28B has a header 30A, 30B and an integrated circuit 34A, 34B, respectively. The first module 28A is positioned within integration plate 20A. Adjacent to integration plate 20A is an RF distribution board 48A having a dielectric layer 72A, a RF conductive layer 74A, and a second dielectric layer 76A; the board could be many layers. DC distribution board 58A is adjacent to RF distribution plate 48A. DC pin 38A extends through RF distribution plate 48A and couples to socket 99 that couples to DC distribution layer 58A. Second module 28B is positioned within a second integration plate 20B. Second integration plate is adjacent to DC distribution layer 58A. Adjacent to integration plate 20B is a second RF distribution board 48B. A second DC distribution board 58B is adjacent to RF distribution plate 48B. A housing layer 89 is coupled to DC distribution layer 58 and is used to hold RF output 46.

The RF path through multiple slice circuit 86 includes introducing the RF signal through RF input 44. RF signal 44 is coupled to RF distribution plate 48A through pressure contact 62A. RF signals travel through RF conductive layer 74A to second pressure contact 62B. Second pressure contact 62B couples signals into integrated circuit 34A where the signals are processed. The output of integrated circuit 34A is coupled to third pressure contact 62C. RF signals are again routed through RF conductive layer 74A to fourth pressure contact 62D. Signals from pressure contact 62D are coupled into RF conductive layer 74B and into fifth pressure contact 62E. Both layers 74A and 74B may actually be comprised of several conductive layers. From pressure contact 62E, signals are coupled into integrated circuit 34B where they are processed for a second time. Processed signals are again coupled to RF conductive layer 74B through a sixth pressure contact 62F. A seventh pressure contact 62G RF couples the layer 74B and RF output 46. Although not described above, each pressure contact 62A through 62G has an appropriate dielectric spacer to create a matched impedance coaxial structure.

DC pins 38A and 38B route DC command and control signals from respective DC distribution boards 58A and 58B.

It will be appreciated from FIG. 6 that various numbers of layers may be interconnected. This interconnection of various slices is particularly useful for a payload of a spacecraft. The interconnection method is more dense than prior art requiring DC and RF connectors and/or coaxial cable. The result is a smaller and lighter unit. It should be noted that in an actual implementation, additional microwave layers or connecting devices can be provided for testing or other interconnection functions. Also, the particular materials may be varied.

While particular embodiments of the invention have been shown and described, numerous variations and alternate embodiments will occur to those skilled in the art. Accordingly, it is intended that the invention be limited only in terms of the appended claims.

What is claimed is:

1. A circuit assembly comprising:

an integration plate having a cavity;

an RF distribution layer disposed adjacent to said integration plate, said RF distribution layer having an RF conductive layer between a first dielectric layer and a second dielectric layer;

a DC distribution layer disposed adjacent to said RF distribution layer;

an RF input coupled to said RF conductive layer;

a module assembly coupled within the cavity including an integrated circuit coupled to said RF conductive layer through a contact and said DC distribution layer through a feedthrough; and an RF output coupled to said RF conductive layer.

2. A circuit assembly as recited in claim 1 wherein said module assembly comprises a header coupled to said integrated circuit.

3. A circuit assembly as recited in claim 2 wherein said integrated circuit has an upper surface and a lower surface adjacent to said header, said lower surface RF coupled to said RF conductive layer through the contact.

4. A circuit assembly as recited in claim 2 wherein said header is coupled to the first dielectric layer.

5. A circuit assembly as recited in claim 2 further comprising a cover disposed adjacent to said header.

6. A circuit assembly as recited in claim 5 wherein said header has a shoulder, said cover coupled to said shoulder.

7. A circuit assembly as recited in claim 1 wherein said integrated circuit comprises a microwave integrated circuit.

8. A circuit assembly as recited in claim 1 further comprising a spanner ring coupling said module to said integration plate.

9. A circuit assembly as recited in claim 1 wherein said RF input is coupled to said conductive layer through a pressure contact.

10. A circuit assembly as recited in claim 1 further comprising a dielectric spacer coupled to said contact, said contact comprising a pressure contact.

11. A circuit assembly as recited in claim 1 wherein said RF output is coupled to said conductive layer through a pressure contact.

12. A satellite comprising:

a satellite body;

a circuit assembly within said satellite comprising a plurality of slices, each slice comprising, an integration plate having a cavity;

an RF distribution layer disposed adjacent to said integration plate having a conductive layer between a first dielectric layer and a second dielectric layer;

a DC distribution layer disposed adjacent to said RF distribution layer;

an RF input coupled to said RF conductive layer;

a module assembly coupled within the cavity including an integrated circuit coupled to a header, said RF conductive layer through a contact and DC coupled to said DC distribution layer through a feedthrough; and an RF output coupled to said RF conductive layer.

13. A satellite as recited in claim 12 wherein said module comprises a header coupled to said integrated circuit.

14. A satellite as recited in claim 12 wherein said integrated circuit has an upper surface and a lower surface adjacent to said header, said lower surface RF coupled to said RF conductive layer through the contact.

15. A satellite as recited in claim 12 wherein said header is coupled to the first dielectric layer.

16. A satellite as recited in claim 12 further comprising a cover disposed adjacent to said header.

17. A satellite as recited in claim 12 wherein said header has a shoulder said cover coupled to said shoulder.

18. A satellite as recited in claim 12 wherein said integrated circuit comprises a microwave integrated circuit.

19. A satellite as recited in claim 12 further comprising a spanner ring coupling said module to said integration plate.

20. A satellite as recited in claim 12 wherein said RF input is coupled to said conductive layer through a pressure contact.

21. A satellite as recited in claim 12 further comprising a dielectric spacer coupled to said contact said contact comprising a pressure contact.

22. A satellite as recited in claim 12 wherein said RF output is coupled to said conductive layer through a pressure contact.

23. A method of assembling circuit assembly comprising the steps of:

mounting an integrated circuit to a header to form a circuit module;

providing an integration plate having a cavity sized to receive the circuit module;

coupling a DC pin to the integrated circuit; and positioning an opening in the header sized to receive a contact so that the contact directly contacts the integrated circuit; and coupling the circuit module within the cavity.

24. A method as recited in claim 23 further comprising the step of affixing a cover to the integrated circuit, and thereby forming a circuit module.

25. A method as recited in claim 23 wherein the step of coupling the circuit module comprises the step of positioning a spanner ring to hold the header against the integration plate.

26. A method as recited in claim 25 wherein the step of positioning a spanner ring comprises the step of engaging threads on a wall member with threads on the spanner ring.

27. A method as recited in claim 23 wherein the step of coupling the circuit within the cavity comprises the step of RF coupling the integrated circuit to an RF conductive layer.

* * * * *